US011274576B2

(12) United States Patent
Noe

(10) Patent No.: US 11,274,576 B2
(45) Date of Patent: Mar. 15, 2022

(54) MODULE FOR A VARIABLE-LIFT VALVE TRAIN OF AN INTERNAL COMBUSTION ENGINE

(71) Applicant: Schaeffler Technologies AG & Co. KG, Herzogenaurach (DE)

(72) Inventor: Benedikt Noe, Nuremberg (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 17/274,945

(22) PCT Filed: Jun. 5, 2019

(86) PCT No.: PCT/DE2019/100504
§ 371 (c)(1),
(2) Date: Mar. 10, 2021

(87) PCT Pub. No.: WO2020/057684
PCT Pub. Date: Mar. 26, 2020

(65) Prior Publication Data

US 2022/0034242 A1 Feb. 3, 2022

(30) Foreign Application Priority Data

Sep. 18, 2018 (DE) ..... 10 2018 122 787.6

(51) Int. Cl.
*F01L 1/34* (2006.01)
*F01L 1/26* (2006.01)
(Continued)

(52) U.S. Cl.
CPC ..... *F01L 1/267* (2013.01); *F01L 1/18* (2013.01); *F01L 1/46* (2013.01); *F01L 2001/186* (2013.01)

(58) Field of Classification Search
CPC ..... F01L 1/267; F01L 1/18; F01L 1/46; F01L 2001/186
See application file for complete search history.

(56) References Cited

U.S. PATENT DOCUMENTS 4,221,201 A * 9/1980 Soeters, Jr. ..... F02D 13/06 123/90.16
4,305,356 A 12/1981 Walsh
(Continued)

FOREIGN PATENT DOCUMENTS

DE 102017101792 A1 8/2018
DE 102018112811 A1 12/2019
DE 102018120270 A1 2/2020

*Primary Examiner* — Zelalem Eshete
(74) *Attorney, Agent, or Firm* — Matt

(57) ABSTRACT

The disclosure relates to a preassembled module of a variable-lift valve train for an internal combustion engine. The module includes an electric linear actuator that lies on a top side of a base plate of the module. A slide plate, movable by the electric linear actuator by means of a linear guide, also lies on the top side of the base plate. A retaining wall extends under a bottom side of the base plate and has two actuation fingers. A free end of each actuation finger includes a contact surface for moving a coupling slide of a switchable rocker arm. In a region of an outer transverse side of the slide plate, a contact wall arranged in front of the electric linear actuator extends upward. The contact wall contacts an actuation pin of the electric linear actuator to move the slide plate in a longitudinal direction.

20 Claims, 3 Drawing Sheets

(51) Int. Cl.
*F01L 1/46* (2006.01)
*F01L 1/18* (2006.01)

(56) References Cited

U.S. PATENT DOCUMENTS

| | | | |
|---|---|---|---|
| 10,767,517 | B2 | 9/2020 | Elendt et al. |
| 2020/0011212 | A1 | 1/2020 | Biermann et al. |

* cited by examiner

MODULE FOR A VARIABLE-LIFT VALVE TRAIN OF AN INTERNAL COMBUSTION ENGINE

CROSS-REFERENCE TO RELATED APPLICATIONS

This application is the U.S. National Phase of PCT Application No. PCT/DE2019/100504 filed on Jun. 5, 2019, which claims priority to DE 10 2018 122 787.6 filed on Sep. 18, 2018, the entire disclosure of which is incorporated by reference herein.

TECHNICAL FIELD

This disclosure relates to a module for a variable-lift valve train of an internal combustion engine.

BACKGROUND

Such a module having an actuator-loaded slide plate (push rod) and actuation fingers thereon is also referred to as an electronic rocker module. An example of this can be found in DE 10 2017 101 792. A row of exhaust valves of a 3-cylinder internal combustion engine is assigned a common push rod with an electric actuator on the end face in the cylinder head. Two gas exchange valves with the same effect are provided for each cylinder. When the electric actuator is not energized, the push rod is reset via the force of a compression spring arranged near the actuator.

The components of the above-mentioned "long" module must be laboriously mounted on the cylinder head and specially prepared for the respective type of internal combustion engine. For this purpose, the cylinder head has slots for guiding the push rod in the section of the camshaft bearing, through which the comparatively long, filigree push rod, which is difficult to handle, must be guided during assembly; with subsequent assembly of the actuation fingers thereon. The electric actuator is aligned behind the push rod and unnecessarily increases the installation space of the internal combustion engine; in addition, it must be fastened separately.

It is also established that a simultaneous actuation of the series of gas exchange valves has a high power requirement and can only perform for a short time window. In addition, a comparatively strong restoring spring means must be installed. It is completely clear that internal combustion engines with a number of cylinders greater than three are also possible.

SUMMARY

The object is to create a module that is easy to construct and assemble and that can be used in a variety of ways.

According to the disclosure, this object is achieved by the novel features described herein. Accordingly, the novel features relate to an "externally" preassembled module for installation in a cylinder head of the internal combustion engine. The module has a base plate with an electric linear actuator lying on the top side thereof. On the top side or bottom side of the base plate there is a slide plate that can be moved longitudinally with respect the electric linear actuator via a linear guide. From an outer longitudinal side of the slide plate, a retaining wall, which runs mainly under the bottom side of the base plate and has only one or two actuation fingers hanging therefrom, can project orthogonally. In the area of an outer transverse side of the slide plate, a contact wall in front of the electric linear actuator protrudes, the inner end face of which is in contact with an actuation pin of the electric linear actuator for moving the slide plate in one longitudinal direction and the restoring spring means for moving the slide plate in the other longitudinal direction is at least indirectly clamped between the slide plate and the base plate.

Thus, a module without the above-mentioned disadvantages is provided. The now short and easy-to-handle module for the actuation of 1 or 2 switchable rocker arms (outlet or inlet row) of only one cylinder of the internal combustion engine (having three switchable rocker arms with three equally acting gas exchange valves of the cylinder is also conceivable) can be supplied in a completely externally preassembled state to the internal combustion engine and assembled there "from above" in an automated manner or by hand. The transport and handling thereof are comparatively easy. The person skilled in the art will recognize that this module can now be used universally over a wide range of internal combustion engine types. It is also possible to only partially equip a cylinder head with the modules. It is also clear that the individual module only has a comparatively low energy requirement with a sufficiently large switching time window. The actuation fingers can also act on the transverse coupling slides of their assigned switchable rocker arms.

It is clear that the slide plate can also have a solid, block-like design. The same applies to the retaining wall, which, according to an expedient development of the disclosure, is a simple angled sheet. If necessary, the retaining wall can also be an integral component of the base plate. Otherwise, a connection of this to the base plate, for example by welding, riveting, snapping, gluing or a plug connection, is conceivable and provided. In the case of the design as an angled sheet, a particularly rigid and stable arrangement on the base plate can be determined. It is also clear that the retaining wall can also, in simple terms, protrude "upwards" and thus no longer hangs from the slide plate and that the retaining wall is T-shaped in cross-section.

A combination of the slide plate with the retaining wall and contact wall in a sheet metal part is also disclosed. This is an inexpensive and easy-to-manufacture component, which is also easy to assemble.

In a further specification of the disclosure, the base plate is shown, for example, from two simple angled strips (in one piece), between the ends of which the electric linear actuator can be located. To fasten the base plate to the cylinder head, each angled strip has, for example, a bore at the end thereof. In this way, the base plate can be screwed to be parallel to the camshaft or to the longitudinal wall of the internal combustion engine, at suitable contact points on the cylinder head, such as camshaft bearing shells or components close thereto. It is clear that the geometry of the base plate is not limited to the above-mentioned strip shape. It can also have a rectangular or generally polygonal design or also have shaped areas.

An "internal" guide of the slide plate on the module is also disclosed. Accordingly, in simple terms, a linear guide is provided in the actuator direction. To represent them, the slide plate has a longitudinal slot. In this case, pins projecting away from the base plate or a sliding block or the like run in this longitudinal slot, on which components the slide plate thus experiences a "rail-like" and torsion-proof longitudinal guide. Alternatively, the longitudinal slot can also be located in the base plate, into which the pins or the sliding block then protrude from the slide plate. In necessary, a roller bearing linear guide (roller circulation, ball circulation) can also be installed.

In addition, a development of the disclosure provides for the restoring spring means for the slide plate to be integrated in the module. For this purpose, at least one simple helical compression spring is provided, which is clamped between the contact wall and a collar of a support stump, which support stump is encompassed by the helical compression spring and on its side remote from the collar, movably penetrating the contact wall, stands on the retaining wall and can also be finely adjusted thereon. Alternatively, an electromagnetic or other resetting can again also take place via a servo means.

The flexible actuation fingers made of spring steel can be provided as components that are joined separately to the retaining wall. The idea here is to simply suspend these on the upper end face of the retaining wall. However, it is also conceivable and intended to design the actuation fingers, if necessary, as a one-piece component of the retaining wall.

The respective actuation finger has a twisted geometry and is thus skillfully guided to the respective switchable rocker arm in the narrow cylinder head area.

Alternatively, an electric actuator or hydraulic or pneumatic control element can generally be used instead of the electric linear actuator. It is also clear that, if necessary, the slide piece can be reset via the same electric linear actuator or the same control element, or precisely one actuator is used for each displacement direction.

DETAILED DESCRIPTION OF THE EMBODIMENTS

Figure 1:
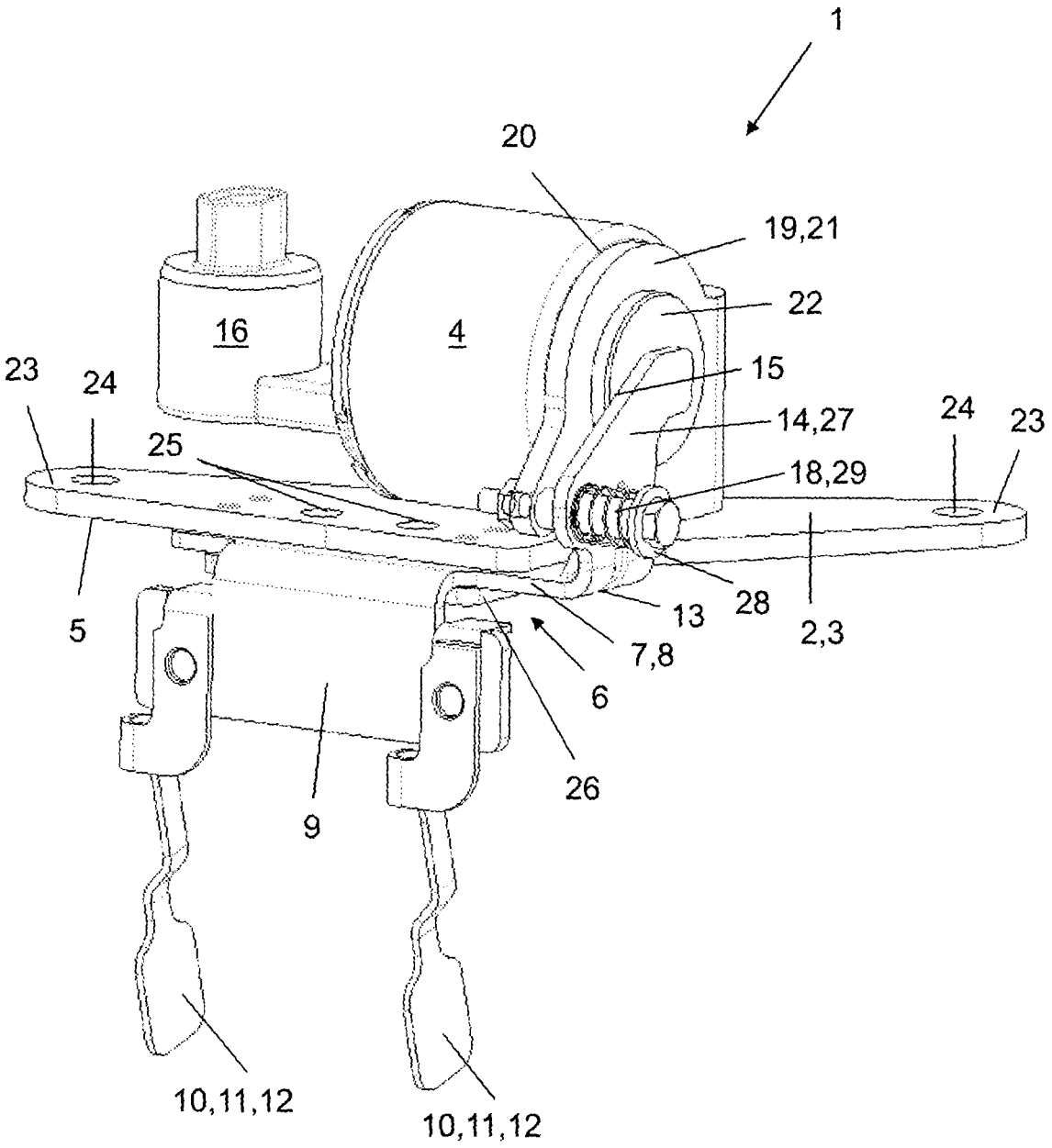
FIG. 1 shows a spatial front view of the module with the "bottom" slide plate.

A short module 1 for a variable-lift valve train of an internal combustion engine is shown.

The module 1 with all the components described below can be supplied in a preassembled state to a cylinder head of the internal combustion engine and screwed thereonto.

The module 1 has a base plate 2 made of sheet steel, consisting substantially of two angled strips running towards one another, at the free ends 23 of which bores 24 are provided for connecting the module 1 to the cylinder head.

An electric linear actuator 4 is located on a top side 3 of the base plate 2, the electrical connection (plug 16) of which is angled upwards, which saves installation space in the longitudinal direction of the module. According to a first variant according to FIGS. 1 and 2, a slide plate 7 which can be moved longitudinally via a linear guide 6 to the electric linear actuator 4 is located on a bottom side 5.

It can be seen that from an outer longitudinal side 8 of the slide plate 7, a retaining wall 9 with two separate actuation fingers 10 made of spring steel protrudes orthogonally downwards. The actuation fingers 10 are suspended longitudinally spaced apart from one another on the retaining wall 9 and fastened (screwed/clinched) thereto and have a twisted course. Each of these has a contact surface 12 at the free end 11 thereof for moving a transverse coupling slide of a switchable rocker arm (not shown).

On an outer transverse side 13, behind the base plate 2, a contact wall 14, which is positioned in front of the electric linear actuator 4, is bent up in one piece from the slide plate 7. An inner end face 15 is contacted by a central actuation pin 17 (see FIG. 2) of the electric linear actuator 4 for moving the slide plate 7 (with retaining wall and contact wall 9, 14 and actuation fingers 10 thereon) in a longitudinal direction (according to FIG. 1 to the right, according to FIG. 2 to the left).

To reset the slide plate 7, the module 1 has a restoring spring means 18. In both variants (FIGS. 1 and 2, variant 1; FIG. 3, variant 2), this is provided as a helical compression spring. According to the solution of FIGS. 1 and 2, it acts at one end against an outer end face 27 of the above-mentioned contact wall 14 facing away from the actuator. At the other end, it acts against a collar 28 of a support stump 29 encompassed by the helical compression spring 18. The support stump 29 here penetrates the contact wall 14 in a longitudinally movable manner and acts on the actuator side against a separate retaining wall 19.

Said retaining wall 19 stands orthogonally on the base plate 2 in both solutions. The electric linear actuator 4 rests firmly on a rear side 20 of the retaining wall 19. For this purpose, a flange piece 22 is provided, which sits on a front side 21 of the retaining wall 19 remote from the actuator and penetrates said retaining wall. The electric linear actuator 4 is thus firmly clamped to the retaining wall 19 via the flange piece 22. If required, the electric linear actuator 4 can also have fastening means for the base plate 2 itself.

Figure 2:
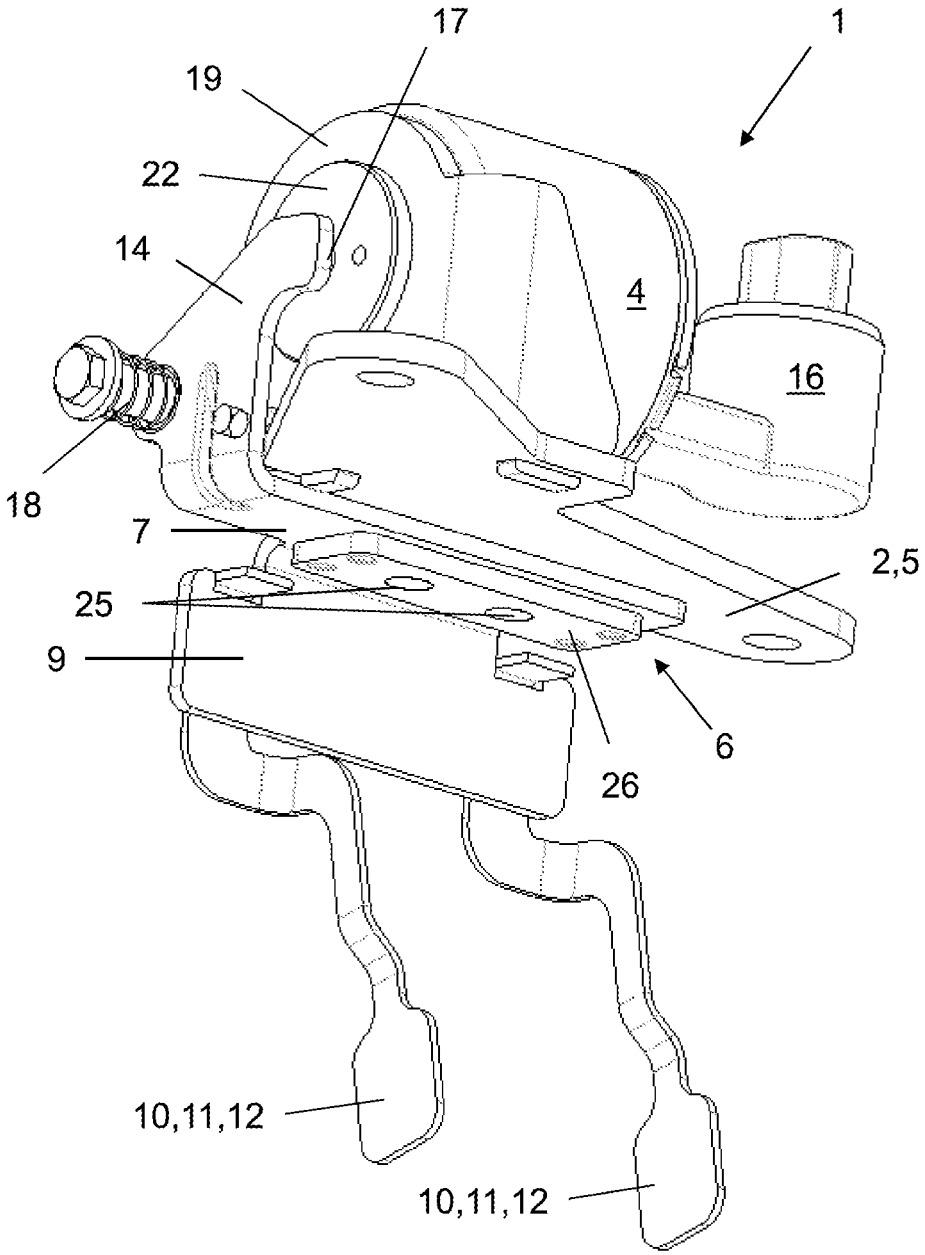
FIG. 2 shows a spatial rear view of the above-mentioned module.
Figure 3:
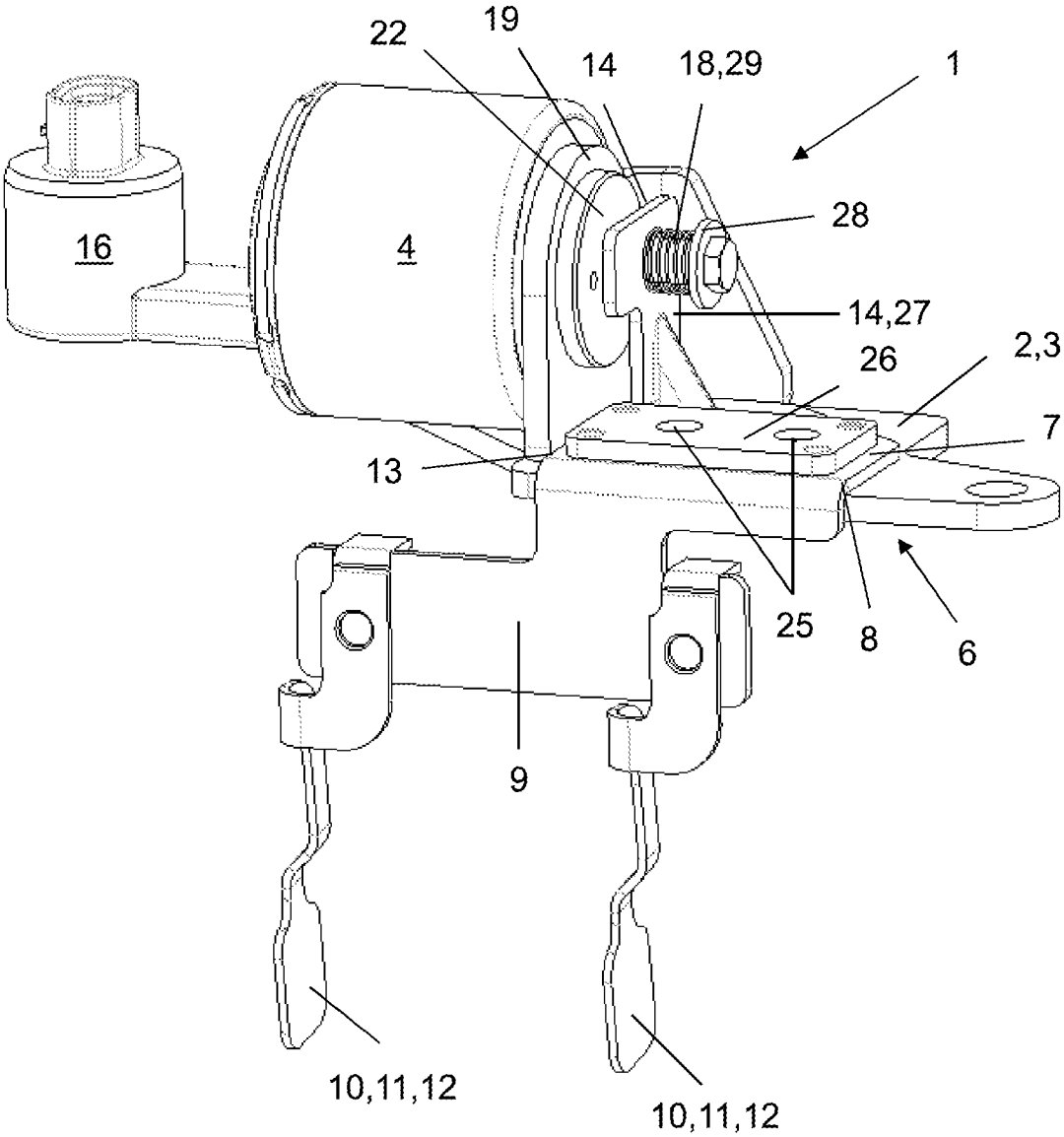
FIG. 3 shows a three-dimensional front view of the variant of the module with the "top" slide plate.

According to the solution according to FIGS. 1 and 2 with the slide plate 7 running on the bottom side 5 of the base plate 2, two pins 25 protrude downwards from the base plate 2. The slide plate 7 is guided translationally thereon with a longitudinal slot (not shown). A sliding plate 26 is fastened to the pins 25 at a distance from the base plate 2. The slide plate 7 is thus guided and held between this and the base plate 2 (keyword: linear guide 6). An alternative design is not shown, in which a tongue and groove connection is applied instead of the above-mentioned pin guide. Here, for example, a longitudinal nose can protrude away from the bottom side 5 of the base plate 2, in which longitudinal nose the slide plate 7 is guided with a complementary longitudinal slot. Depending on the embodiment (stepped longitudinal nose), the sliding plate 26 may or may not still be required. The same applies to an embodiment with optionally stepped pins 25 (omitted for stepped pins).

According to the variant shown in FIG. 3 with the slide plate 7 running on the top side 3 of the base plate 2, two pins 25 protrude upwards from the base plate 2. The slide plate 7 is again guided translationally thereon with a longitudinal slot (not shown). At a distance from the base plate 2, the sliding plate 26 is again fastened to the pins 25, between which and the base plate 2 the slide plate 7 is thus again longitudinally guided.

LIST OF REFERENCE SYMBOLS

1 Module
2 Base plate
3 Top side
4 Electric linear actuator
5 Bottom side
6 Linear guide
7 Slide plate
8 Outer longitudinal side

9 Retaining wall
10 Actuation finger
11 End
12 Contact surface
13 Outer transverse side
14 Contact wall
15 Inner end face
16 Plug
17 Actuation pin
18 Restoring spring means
19 Retaining wall
20 Rear side
21 Front side
22 Flange piece
23 End
24 Bore
25 Pin
26 Sliding plate
27 Outer end face
28 Collar
29 Support stump

The invention claimed is:

1. A preassembled module for a variable-lift valve train configured to be installed within a cylinder head of an internal combustion engine, the preassemble led module comprising:

a base plate configured to attach the preassembled module to the cylinder head;

an electric linear actuator arranged on a top side of the base plate;

a slide plate longitudinally movable relative to the electric linear actuator, and the slide plate slidably guided via a bottom side of the base plate;

a first retaining wall extending away from the bottom side of the base plate, the first retaining wall having at least one actuation finger extending away from the first retaining wall, a free end of the at least one actuation finger having a contact surface configured to move a coupling slide of a switchable rocker arm;

a contact wall extending vertically in front of the electric linear actuator in a region of an outer transverse side of the slide plate, the contact wall having an inner end face configured to be actuated by the electric linear actuator to move the slide plate in a first longitudinal direction; and, a restoring spring operatively arranged between the slide plate and the base plate, the restoring spring configured to move the slide plate in a second longitudinal direction.

2. The preassembled module of claim 1, further comprising a second retaining wall connected to the top side of the base plate, the second retaining wall extending between the front of the electric linear actuator and the contact wall.

3. The preassembled module of claim 2, wherein the second retaining wall is an angled sheet.

4. The preassembled module of claim 1, wherein the slide plate is formed in one piece with the first retaining wall and the contact wall and bent from sheet steel.

5. The preassembled module of claim 1, wherein the base plate comprises two angled strips extending towards each other, and bores are arranged at a free end of each of the two angled strips, the bores configured to connect the preassembled module to the cylinder head.

6. The preassembled module of claim 1, further comprising at least one pin fastened to the base plate and extending through the slide plates, the at least one pin arranged to longitudinally guide the slide plate in the first and second longitudinal direction.

7. The preassembled module of claim 6, further comprising a sliding plate fastened to the at least one pin, the sliding plate spaced apart from the base plate and defining a longitudinal space, the slide plate disposed within and slidably guided by longitudinal space in the first and second longitudinal directions.

8. The preassembled module of claim 1, wherein the restoring spring includes:

a first end forcibly engaged with an outer end face of the contact wall, the outer end face facing away from the electric linear actuator; and, a second end forcibly engaged with a collar of a support stump, the support stump encompassed by the restoring spring, and the support stump longitudinally movable through the contact wall and supported by the electric linear actuator or the base plate.

9. The preassembled module of claim 1, wherein the at least one actuation finger is a separate spring steel component.

10. A preassembled module for a variable-lift valve train configured to be installed within a cylinder head of an internal combustion engine, the preassembled module comprising:

a base plate configured to attach the preassembled module to the cylinder head;

an electric linear actuator arranged on an upper longitudinal side of the base plate;

a slide plate having:

a first retaining wall extending below a lower longitudinal side of the base plate;

at least one actuating finger extending below and from the first retaining wall, the at least one actuating finger configured to move in a first longitudinal direction to move a coupling slide of a switchable rocker arm;

a first longitudinal side and a second longitudinal side; one of the first or second longitudinal sides slidably engaging a third longitudinal side of the base plate, and the first and second longitudinal sides of the slide plate are parallel to the third longitudinal side of the base plate; and, a contact wall extending from the third longitudinal side of the base plate toward an actuating end of the electric linear actuator such that the contact wall extends above the upper longitudinal side of the base plate; and actuation of the contact wall by the electric linear actuator moves the contact wall in the first longitudinal direction such that: i) the one of the first or second longitudinal sides slidably moves against the third longitudinal side in the first longitudinal direction, and ii) the at least one actuation finger moves in the first longitudinal direction; and the contact wall, slide plate, and at least a portion of the at least one actuating finger move in unison in the first longitudinal direction.

11. The preassembled module of claim 10, wherein the at least one actuating finger comprises a first actuation finger and a second actuation finger, the first actuation finger configured to move a first coupling slide of a first switchable rocker arm, and the second actuation finger configured to move a second coupling slide of a second switchable rocker arm.

12. The preassembled module of claim 10, wherein the slide plate, the first retaining wall, and the contact wall are integrally formed from one piece.

13. The preassembled module of claim 10, wherein the slide plate, the first retaining wall, and the contact wall each move linearly in the first longitudinal direction.

14. The preassembled module of claim 10, further comprising a restoring spring operatively arranged between the slide plate and the base plate, the restoring spring configured to move the slide plate in a second longitudinal direction, opposite the first longitudinal direction.

15. The preassembled module of claim 14, further comprising a second retaining wall attached to and extending from the base plate and supporting the actuating end of the electric linear actuator, the restoring spring operatively arranged between the second retaining wall and the slide plate.

16. The preassembled module of claim 14, wherein an end of the restoring spring is configured to move linearly in the first longitudinal direction when the electric linear actuator moves the contact wall in the first longitudinal direction.

17. The preassembled module of claim 10, further comprising a sliding plate having a fourth longitudinal side offset from a remaining one of the first or second longitudinal sides of the slide plate to form a space, and the slide plate is disposed in the space, and the fourth longitudinal side is parallel to the first and second longitudinal sides.

18. The preassembled module of claim 17, wherein the fourth longitudinal side slidably moves against the remaining one of the first or second longitudinal sides of the slide plate in the first longitudinal direction when the electric linear actuator moves the contact wall in the first longitudinal direction.

19. The preassembled module of claim 10, wherein the at least one actuating finger includes a contact surface, the contact surface defining a plane arranged orthogonally to the first and second longitudinal sides.

20. The preassembled module of claim 10, further comprising:

a second retaining wall attached to and extending from the base plate towards the actuating end of the electric linear actuator; and, a flange piece arranged between the second retaining wall and the contact wall; and, the electric linear actuator clamped to the second retaining wall via the flange piece.

* * * * *